US006557969B1

(12) United States Patent
Murakami et al.

(10) Patent No.: US 6,557,969 B1
(45) Date of Patent: May 6, 2003

(54) PRINTING APPARATUS AND SUCTION RECOVERY CONTROL METHOD

(75) Inventors: Shuichi Murakami, Kawasaki (JP); Toshiharu Inui, Yokohama (JP); Yoshiyuki Touge, Sagamihara (JP); Masaya Uetsuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/511,360

(22) Filed: Feb. 23, 2000

(30) Foreign Application Priority Data

Feb. 24, 1999 (JP) ..... 11-047155

(51) Int. Cl.[7] ..... B41J 2/165
(52) U.S. Cl. ..... 347/23; 347/30
(58) Field of Search ..... 347/22, 23, 30, 347/35

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,723,129 A | | 2/1988 | Endo et al. | 346/1.1 |
| 4,740,796 A | | 4/1988 | Endo et al. | 346/1.1 |
| 5,638,100 A | | 6/1997 | Kanematsu et al. | 347/35 |
| 5,781,204 A | * | 7/1998 | Kanematsu et al. | 347/23 |
| 5,818,604 A | | 10/1998 | Delabastita et al. | 358/298 |
| 5,850,237 A | * | 12/1998 | Slade | 347/23 |

FOREIGN PATENT DOCUMENTS

| | | |
|---|---|---|
| EP | 0 589 581 | 3/1994 |
| EP | 0 622 202 | 11/1994 |
| EP | 0 694 403 | 1/1996 |
| JP | 59-123670 | 7/1984 |
| JP | 59-138461 | 8/1984 |
| JP | 6-238914 | 8/1994 |
| JP | 8-216437 | 8/1996 |

OTHER PUBLICATIONS

European Search Report in EP 00 30 1421, dated Aug. 9, 2002.

European Search Report in EP 00 30 1421.4, dated Dec. 12, 2002.

* cited by examiner

*Primary Examiner*—Huan Tran
(74) *Attorney, Agent, or Firm*—Fitzpatrick, Cella, Harper & Scinto

(57) ABSTRACT

An ink-jet printing apparatus and suction recovery control method which can minimize reduction in throughput while maintaining a printhead in the most appropriate condition, and can reduce the amount of wasted ink. According to the suction recovery control method, a printing period of predetermined printing operation is timed, and the number of print dots formed by discharging ink from a printhead during the predetermined printing operation is counted. Based on the timed printing period and counted number of print dots, the number of print dots per unit time is calculated. Then based on the calculated number of print dots per unit time, timing of suction recovery operation is determined, and suction recovery operation of the printhead is performed according to the determined timing.

14 Claims, 11 Drawing Sheets

PRINTING APPARATUS AND SUCTION RECOVERY CONTROL METHOD

FIELD OF THE INVENTION

The present invention relates to a printing apparatus and suction recovery control method, and more particularly, to a printing apparatus employing a printhead which performs printing in accordance with an ink-jet printing method, and suction recovery control method.

BACKGROUND OF THE INVENTION

A printing apparatus, employed in a printer or a printer unit of a copy machine or facsimile apparatus or the like, prints an image based on inputted image data by forming dot patterns on a print medium, e.g., paper, thin plastic sheet, fabric or the like.

Such printing apparatus can be categorized according to printing methods, e.g., ink-jet method, wire dot method, thermal-transfer method, laser-beam method and so on.

Among these printing apparatuses, the type employing ink-jet printing method which performs printing by discharging ink from a printhead to a print medium is advantageous, not only because printing can be performed with high precision at high speed, but because printing can be performed with low noise by virtue of the non-impact method, and color images can easily be printed with multiple colors of ink.

Furthermore, according to a bubble-jet method of the ink-jet printing method, ink is heated to cause film boiling and ink is discharged by pressure of bubbles generated by the film boiling. The bubble-jet method is known to realize high resolution printing and high speed printing even more easily.

An ink-jet printing apparatus, using ink as a recording material for printing, attributes importance to reliability maintenance for the ink discharge function of a printhead, in order to prevent negative influence on printing, caused by ink evaporation or bubble mixture in ink.

More specifically, while an ink-jet printing apparatus is performing printing operation or is not in use, bubbles are gradually generated inside the ink discharge nozzles of the printhead or in the inserted portion of the printhead. This may disable ink discharge (no discharge) or cause discharge failure, disabling normal print operation. In order to eliminate these bubbles, the ink-jet printing apparatus comprises a cap for capping the printhead, and a head recovery unit having a suction pump for sucking ink inside the cap. The ink discharge surface of the printhead is capped at the position where the printhead faces against the cap, and the suction pump sucks bubbles inside the printhead. The suction recovery processing is an important technique for reliability maintenance of the ink-jet printing apparatus.

However, even if a suction condition is determined so as to make full use of the bubble-eliminating capability of the head recovery unit, in reality, volumes of bubbles vary in different suction operations. Therefore, the same bubble-eliminating performance cannot always be achieved. In view of this, in order to maintain excellent bubble-eliminating performance, the conventional ink-jet printing apparatus counts the number of times of discharge, or times the non-printing state period of the apparatus, or executes both, so that the suction is performed while the bubble volume is as constant as possible, and then controls suction operation in accordance with the counted values. More specifically, the timing of suction operation of the printhead is determined based on the point of time whichever earlier: at which a predetermined time has elapsed from an initial point of time, or at which a predetermined amount of printing is completed from the initial point of time.

Japanese Patent Application Laid-Open (KOKAI) No. 6-238914 proposes a method of determining timing of suction operation of a printhead based on the number of times of discharge, non-printing state period of the printer, and temperature of the printhead, taking into account a difference in the bubble generation amount in the head caused by a temperature rise inside the printhead.

However, the reliability maintenance employed in the conventional ink-jet printing apparatus does not consider the number of times of discharge per unit printing area of a printhead (e.g., actual number of times of discharge while an image corresponding to one line is printed on A4-size paper. Hereinafter referred to as a print image duty). Therefore, depending on a print image duty, suction operation is unnecessarily performed, causing to reduce the throughput of the printing apparatus or increase the amount of wasted ink, or causing discharge failure by bubbles before suction operation is performed.

Particularly, the bubble-jet method employs a method of locally heating ink to cause film boiling to generate ink discharge energy. According to this method, the internal temperature of the printhead gradually rises as printing operation is performed, and as a result of the temperature rise, the generation state or growth rate of bubbles changes. In view of this, as described above, the conventional example proposes a method of determining the timing of suction operation of the printhead based on the number of times of discharge, non-printing state period of the printer, and printhead temperature.

However, this method has the following problems.

(1) The temperature rise of a printhead varies for each head.

(2) Temperature detection accuracy of a printhead varies, making accurate control difficult.

(3) The internal temperature of a printhead differs depending on a pattern of a printing image.

Hereinafter, these three problems are described further in detail.

The following facts have been discovered as a result of careful study of causes and mechanism of bubble generation in a printhead which causes discharge failure.

In a case where printing operation is performed by a printhead employing an ink-jet printing method, small bubbles are first generated in the printhead, and then these bubbles are coalesced to grow into large bubbles. After the bubbles are first generated, if ink is not discharged from the printhead, these bubbles melt in the ink and disappear. Therefore, it is considered that the condition for small bubbles to coalesce and grow into large bubbles is to repeat ink discharge from the printhead within a predetermined time period before small bubbles disappear. In other words, if the printhead performs many times of ink discharge within a unit time period, bubbles coalesce and grow before disappearing, thus causing discharge failure.

FIG. 10 shows a relation between the number of lines printed by a printhead before discharge failure occurs, and a print time duty. Note that the print time duty is the number of print dots per unit time (dot/second).

As can be apparent from FIG. 10, as the number of print dots per unit time increases, discharge failure occurs at the smaller number of line, i.e., discharge failure occurs in the earlier stage.

If the internal temperature of the printhead is further taken into consideration, the case where the number of print dots per unit time is large and the internal temperature is low is more likely to cause discharge failure than the case where the number of print dots per unit time is small and the internal temperature is high.

As described above, mere detection of a printhead temperature is not sufficient for determining suction operation timing. Particularly when an ink-jet printing apparatus is in a print stand-by state during print data transfer, growth of bubbles, i.e., occurrence of discharge failure, is more highly correlated with the number of print dots per unit time than the printhead temperature, as is apparent from the aforementioned study. Furthermore, in a case where an ink-jet printing apparatus executes control (hereinafter referred to as temperature rise detection) such that printing is allowed only when the printhead temperature is lower than a predetermined temperature, discharge failure occurs depending on the print time duty rather than the printhead temperature.

In other words, mass-produced ink-jet printheads differ in various printing characteristics. Therefore, even in a case where the same print data is inputted to print the same image, consideration must be given in that there may be a printhead which easily raises temperature and a printhead which does not easily raise temperature. Therefore, despite execution of temperature rise detection, the printhead which does not easily raise temperature is more likely to allow printing than the printhead which easily raises temperature. In other words, the printhead which does not easily raise temperature is more likely to perform printing consecutively or perform a number of times of printing within the unit time than the printhead which easily raises temperature.

Therefore, the printhead which has a low temperature and does not easily raise the temperature, is more likely to cause discharge failure by bubbles in the printhead, than the printhead which has a high temperature and easily raises the temperature. As described above, an ink-jet printing apparatus raises a problem in that the conventional temperature rise detection cannot sufficiently prevent discharge failure because there are cases where discharge failure due to bubbles in the printhead occurs when a printhead has a low temperature rather than a high temperature.

Furthermore, in the conventional method of determining the timing of suction operation of a printhead based on the number of times of discharge, non-printing state period, and printhead temperature, there is a problem because the precision of a head temperature sensor of the ink-jet printing apparatus is not sufficient.

More specifically, even if the printhead temperature (detected temperature) detected by the sensor of the printing apparatus is low, there may be cases that the actual printhead temperature is higher than the detected temperature. In this case, suction operation is not performed, causing discharge failure. On the contrary, even if the printhead temperature (detected temperature) detected by the sensor of the printing apparatus is high, there may be cases that the actual printhead temperature is lower than the detected temperature. In this case, the number of times of suction operation may unnecessarily increase, resulting in a reduced throughput of printing operation and the increased amount of wasted ink.

Furthermore, there may be cases where the timing of suction operation cannot accurately be determined depending on the printing pattern. For instance, as shown in FIG. 11A, in a case of printing a pattern having a high print image duty in the first half of a print medium and a pattern having a low print image duty in the latter half of the print medium, the printhead temperature detected at the end of printing the pattern on the print medium is relatively low compared to a case of printing a pattern having a uniform print image duty on the entire print medium. Because of this, suction operation is not performed, causing discharge failure.

On the contrary, as shown in FIG. 11B, in a case of printing a pattern having a low print image duty in the first half of a print medium and a pattern having a high print image duty in the latter half of the print medium, the printhead temperature detected at the end of printing the pattern on the print medium is relatively high compared to a case of printing a pattern having a uniform print image duty on the entire print medium. Because of this, the number of times of suction operation may unnecessarily increase, resulting in a reduced throughput of printing operation and the increased amount of wasted ink.

The above-described problems may be solved by executing suction recovery operation while printing one page of print medium. However, performing suction recovery operation may cause to change the state of ink in a printhead. Therefore, if suction recovery operation is performed during printing of one page of print medium, tonality of an image printed on the print medium may change. For this reason, it is not preferable to execute suction recovery operation during printing of one page of print medium.

As summarized, it is extremely difficult to execute appropriate printing control according to the printhead temperature of an ink-jet printing apparatus.

SUMMARY OF THE INVENTION

The present invention is made in consideration of the above situation, and has as its object to provide an ink-jet printing apparatus and suction recovery control method which can minimize reduction in throughput while maintaining a printhead in the most appropriate condition, and can reduce the amount of wasted ink.

According to one aspect of the present invention, the foregoing object is attained by providing a suction recovery control method of controlling suction recovery operation of a printhead used in an ink-jet printing apparatus, comprising: a first timing step of timing a printing period of predetermined printing operation; a counting step of counting a number of print dots formed by discharging ink from the printhead during the predetermined printing operation; a calculating step of calculating a number of print dots per unit time based on the printing period timed in the first timing step and the number of print dots counted by the counting step; a deciding step of deciding a timing of the suction recovery operation based on the number of print dots per unit time calculated in the calculating step; and a control step of controlling the suction recovery operation of the printhead at the timing decided in the deciding step.

Herein, it is preferable that the deciding step includes: a correction step of correcting the counted number of print dots based on the calculated number of print dots per unit time; a first comparing step of comparing the number of print dots, corrected in the correction step, with a predetermined threshold value each time printing of one page of print medium is completed; and a determining step of determining whether or not to perform suction recovery operation according to a comparison result of the first comparing step.

Furthermore, the aforementioned method further comprises a second timing step of timing a cumulative time period, starting from when power to the ink-jet printing apparatus is first turned on.

It is preferable that the deciding step includes a second comparing step of comparing the cumulative time period with a predetermined threshold value each time the printing of one page of print medium is completed, and in the determining step, the timing of suction recovery operation is determined according to a comparison result of the second comparing step.

Note that the predetermined printing operation corresponds to performing printing of one page of print medium or performing printing of one scan of the printhead.

Furthermore, the predetermined threshold value employed in the first and second comparing steps is obtained by experimentally counting, in advance, a number of print dots formed before the printhead results in ink discharge failure.

Furthermore, it is preferable that in the determining step, the timing of suction recovery operation is a point of time whichever earlier: at which the number of print dots, corrected in the correction step, exceeds the predetermined threshold value in the first comparing step; or at which the cumulative time period exceeds the predetermined threshold value in the second comparing step.

According to another aspect of the present invention, the foregoing object is attained by providing a suction recovery control method of controlling suction recovery operation of a printhead used in an ink-jet printing apparatus, comprising: a counting step of counting a number of print dots, formed by discharging ink from the printhead, every predetermined printing area; a calculating step of calculating a number of print dots per unit printing area based on the number of print dots counted in the counting step and a total number of dots printable in the predetermined printing area; a deciding step of deciding a timing of the suction recovery operation based on the number of print dots per unit printing area calculated in the calculating step; and a control step of controlling the suction recovery operation of the printhead at the timing decided in the deciding step.

It is preferable that the deciding step includes: a correction step of correcting the counted number of print dots based on the calculated number of print dots per unit printing area; a first comparing step of comparing the number of print dots, corrected in the correction step, with a predetermined threshold value each time printing of the predetermined printing area is completed; and a determining step of determining whether or not to perform suction recovery operation according to a comparison result of the first comparing step.

Furthermore, it is preferable that the aforementioned method further comprises a timing step of timing a cumulative time period, starting from when power to the ink-jet printing apparatus is first turned on.

In this case, it is preferable that the deciding step includes a second comparing step of comparing the cumulative time period with a predetermined threshold value each time printing of the predetermined printing area is completed, wherein in the determining step, the timing of the suction recovery operation is determined according to a comparison result of the second comparing step.

Note that the predetermined printing area corresponds to an area printed by one scanning of the printhead.

According to still another aspect of the present invention, the foregoing object is attained by providing a printing apparatus for printing on a print medium by using an ink-jet printhead, comprising: suction recovery means for performing suction recovery operation of the ink-jet printhead; first timing means for timing a printing period of predetermined printing operation; counting means for counting a number of print dots formed by discharging ink from the ink-jet printhead during the predetermined printing operation; calculation means for calculating a number of print dots per unit time based on the printing period timed by the first timing means and the number of print dots counted by the counting means; decision means for deciding a timing of the suction recovery operation based on the number of print dots per unit time calculated by the calculation means; and control means for controlling the suction recovery operation at the timing decided by the decision means.

Furthermore, it is preferable that the aforementioned apparatus further comprises second timing means for timing a cumulative time period, starting from when power to the printing apparatus is first turned on, wherein the decision means decides the timing of the suction recovery operation while further considering the cumulative time period.

According to still another aspect of the present invention, the foregoing object is attained by providing a printing apparatus for printing on a print medium by using an ink-jet printhead, comprising suction recovery means for performing suction recovery operation of the ink-jet printhead; counting means for counting a number of print dots, formed by discharging ink from the printhead, every predetermined printing area; calculation means for calculating a number of print dots per unit printing area based on the number of print dots counted by the counting means and a total number of dots printable in the predetermined printing area; decision means for deciding a timing of the suction recovery operation based on the number of print dots per unit printing area calculated by the calculation means; and control means for controlling the suction recovery operation of the printhead at the timing decided by the decision means.

Furthermore, it is preferable that the aforementioned apparatus further comprises timing means for timing a cumulative time period, starting from when power to the printing apparatus is first turned on, wherein the decision means decides the timing of the suction recovery operation while further considering the cumulative time period.

Furthermore, in a case where the apparatus comprises scanning means for reciprocally scanning the ink-jet printhead, the predetermined printing area corresponds to an area printed by one scanning of the ink-jet printhead.

The printhead mentioned in the foregoing configuration comprises electrothermal transducers for generating heat energy to be applied to ink so as to discharge ink by utilizing the heat energy, and the printhead discharges ink from discharge orifices by utilizing film boiling in the ink, which is generated by heat energy applied by the electrothermal transducers.

According to the present invention described above, the printing period of predetermined printing operation is timed, and the number of print dots formed by discharging ink from a printhead during the predetermined printing operation is counted. Based on the timed printing period and counted number of print dots, the number of print dots per unit time is calculated. Then based on the calculated number of print dots per unit time, timing of suction recovery operation is determined, and suction recovery operation of the printhead is performed according to the determined timing.

Alternatively, the number of print dots formed by discharging ink from a printhead is counted each time printing of a predetermined printing area is completed. Based on the counted number of print dots and a total number of dots printable in the predetermined printing area, the number of print dots per unit printing area is calculated. Then based on the calculated number of print dots per unit printing area, timing of suction recovery operation is determined, and suction recovery operation of the printhead is performed according to the determined timing.

The present invention is particularly advantageous since the timing of suction recovery operation of a printhead can be determined by taking into consideration an influence imposed on the printhead actually used in the printing operation.

Therefore, for instance, even if a temperature characteristic of a printhead varies, suction recovery timing can be accurately determined without being influenced by such variation of characteristics. Accordingly, a printhead can be maintained in the most appropriate condition with the minimum number of times of suction recovery operation, reduction in throughput of printing operation can be minimized, and the amount of wasted ink generated by suction recovery operation an be reduced.

Furthermore, also in a case of employing a printing apparatus having the function of printhead temperature detection, the present invention can prevent a situation where temperature detection precision or print data or a printing pattern influences the temperature detection result, and negatively influences the suction recovery timing of a printhead.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention, and together with the description, serve to explain the principles of the invention.

DETAILED DESCRIPTION OF THE PREFERRED EMBODIMENTS

Preferred embodiments of the present invention will be described in detail in accordance with the accompanying drawings.

According to the embodiments which will be described below, a print image duty is defined as follows. A print image duty is the number of print dots printed by ink discharge within a unit printing area, for example, the actual number of times of ink discharge while a printhead performs printing of a single scan (one line) on A4-size paper. In this case, the value of the print image duty may be expressed by a ratio of the number of printed dots to the total number of dots in the unit printing area.

Furthermore, the print time duty is obtained by dividing the number of printed dots, formed by ink discharge, by the time period required to print the printed dots. For instance, in a case of printing 10,000 dots by ink discharge, the print time duty is obtained by dividing 10,000 dots by the time period required to print 10,000 dots. Herein, the time period required for printing may be the period from the start of ink discharge to print the first dot until the end of ink discharge to print the 10,000th dot, or may be the timing convenient for the printing apparatus, e.g., the period from the end of paper feed until the start of paper discharge. In any case, the relation between the print image duty and discharge failure with such timing needs to be clarified in advance.

First Embodiment

Figure 1:
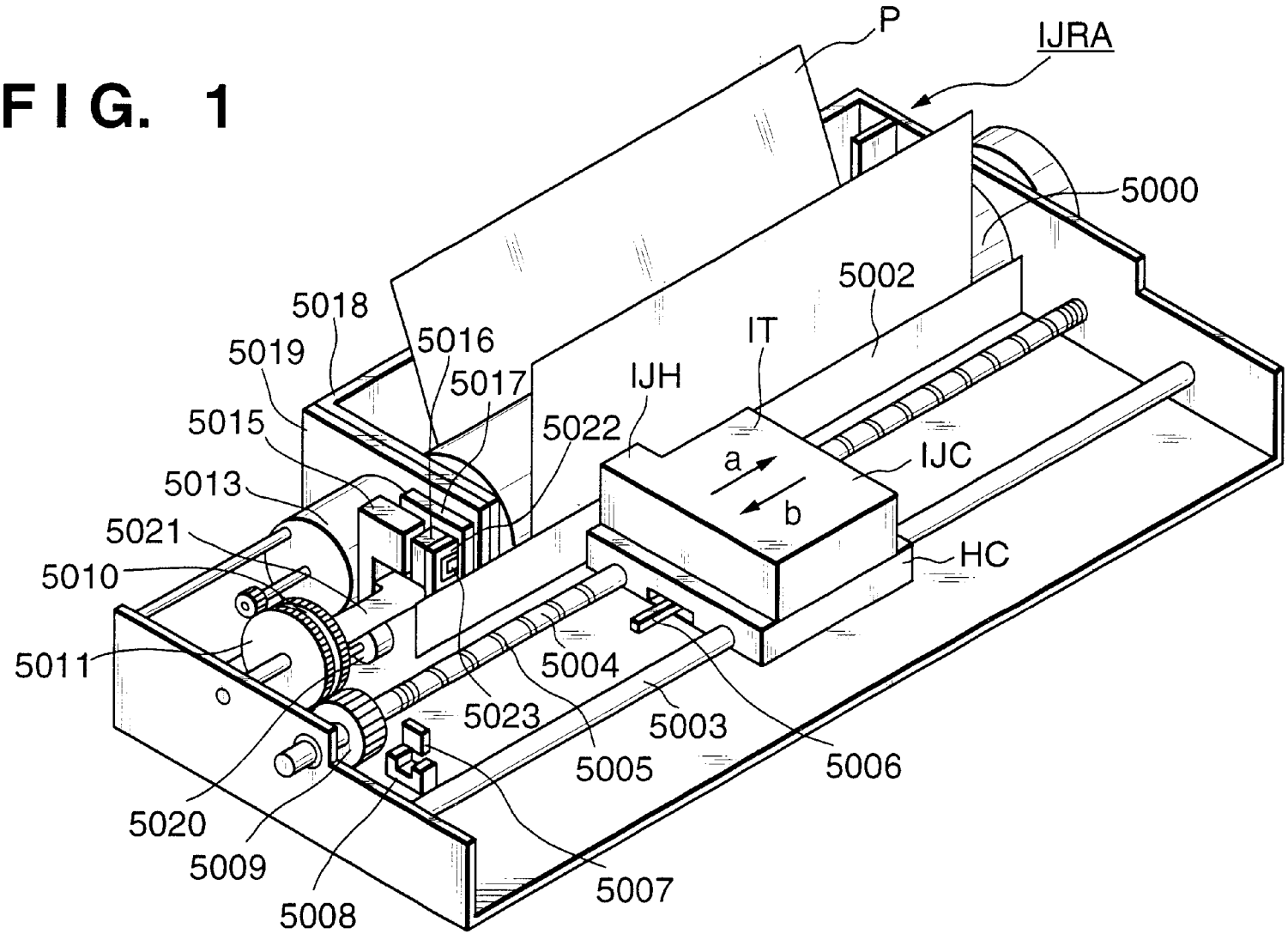
FIG. 1 is a perspective view showing an external appearance of an ink-jet printer IJRA according to a typical embodiment of the present invention.

FIG. 1 is a perspective view showing the outer appearance of an ink-jet printer IJRA as a typical embodiment of the present invention. Referring to FIG. 1, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b in FIG. 1. An integrated ink-jet cartridge IJC which incorporates a printing head IJH and an ink tank IT is mounted on the carriage HC. Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of the motor 5013. Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment. Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

Description of Control Structure

Figure 2:
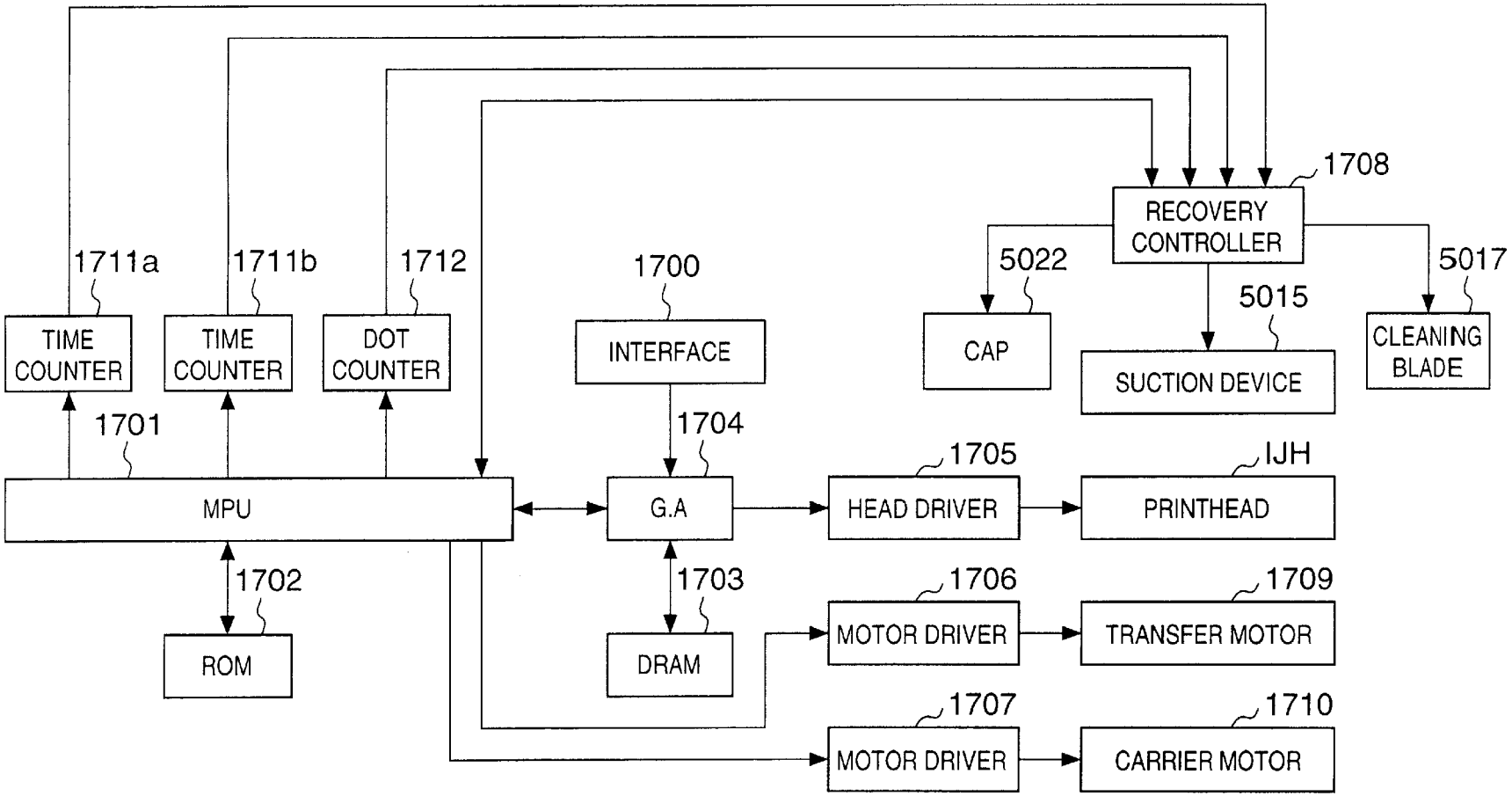
FIG. 2 is a block diagram showing a construction of a control circuit of the ink-jet printer IJRA according to the first embodiment.

Next, the control structure necessary to execute printing control of the above-described printing apparatus is described. FIG. 2 is a block diagram showing the arrangement of a control circuit of the ink-jet printer. Referring to FIG. 2 showing the control circuit, reference numeral 1700 denotes an interface for inputting a printing signal from an external unit such as a host computer; 1701, an MPU; 1702, a ROM for storing a control program executed by the MPU 1701; and 1703, a DRAM for storing various data (the printing signal, printing data supplied to the printing head, and the like). Reference numeral 1704 denotes a gate array (G.A.) for performing supply control of printing data to the printing head IJH. The gate array 1704 also performs data transfer control among the interface 1700, the MPU 1701, and the RAM 1703. Reference numeral 1705 denotes a head driver for driving the printhead IJH; and 1706 and 1707, motor drivers for driving the transfer motor 1709 and the carrier motor 1710.

The operation of the above control arrangement will be described below. When a printing signal is inputted to the interface 1700, the printing signal is converted into printing data for printing operation by the gate array 1704 and the MPU 1701. As the motor drivers 1706 and 1707 are driven, the printhead IJH is driven in accordance with the printing data supplied to the head driver 1705, and performs printing operation.

Furthermore, a recovery controller 1708, controlled by the MPU 1701, controls various recovery operation such as capping the front surface of the printhead IJH with the cap 5022, cleaning the front surface of the printhead IJH with the cleaning blade 5017, suction recovery of the printhead IJH with the suction device 5015 or the like.

A dot counter 1712 counts the number of printed dots formed by ink discharged from the printhead IJH during printing operation. The counted number is outputted as a signal to the recovery controller 1708 along with the progress of the printing operation.

A time counter 1711*a* times a printing period and outputs the time count result to the recovery controller 1708. A time counter 1711*b* starts timing duration of non-printing state of the ink-jet printing apparatus when the power of the ink-jet printer IJRA is first turned on, and outputs the time count result to the recovery controller 1708. Note that the time counter 1711*b* is backed up by a battery. Thus, even if the power supply to the ink-jet printer IJRA is off, the time counter 1711*b* is still operable.

The recovery controller 1708 transmits a suction operation instruction to the suction device 5015 and MPU 1701, based on the timed results outputted by the time counters 1711*a* and 1711*b* and the number of printed dots outputted by the dot counter 1712.

Note that, as described above, the ink-jet cartridge IJC may be the exchangeable type that integrally incorporates the ink tank IT and printhead. Alternatively, an ink tank IT and printhead IJH may be separately provided so that only the ink tank IT can be exchanged when ink is exhausted.

Figure 3:
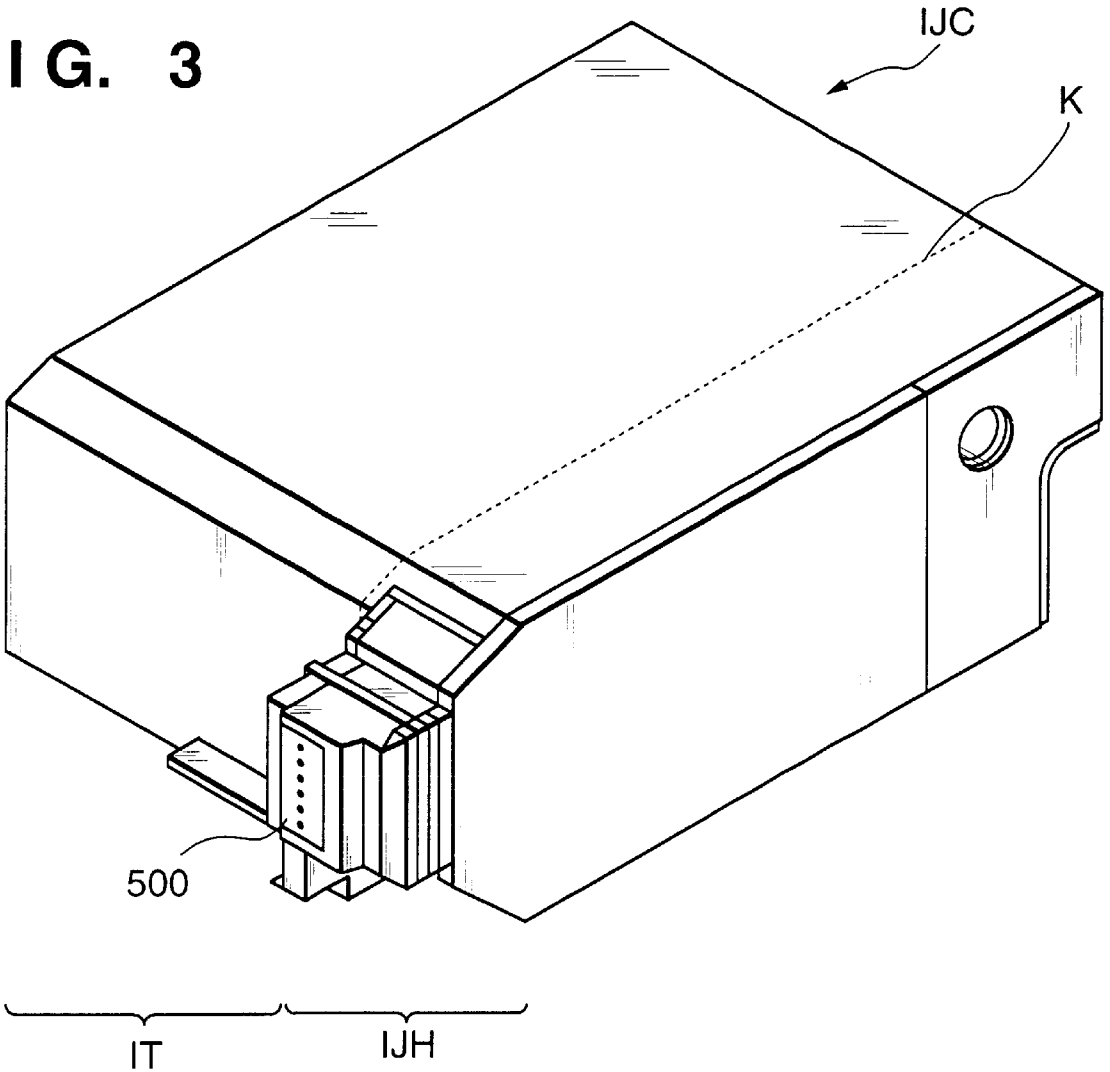
FIG. 3 is a perspective view showing an external appearance of an ink cartridge IJC having a separable ink tank and head.

FIG. 3 is a perspective view showing the outer appearance of the ink-jet cartridge IJC where the printhead IJH and ink tank IT are separable. The ink tank IT is separable from the printhead IJH at the boundary line K as shown in FIG. 3. The ink-jet cartridge IJC includes an electrical contact portion (not shown) so that the ink-jet cartridge IJC receives electrical signals from the carriage HC when mounted on the carriage HC. The printhead IJH is driven by the received electrical signals.

Note that in FIG. 3, reference numerals 500 denotes a ink discharge orifice array. The ink tank IT includes a fibrous or porous ink absorbing member for maintaining ink.

Next, the aforementioned printhead IJH is described with reference to FIG. 4.

Figure 4:
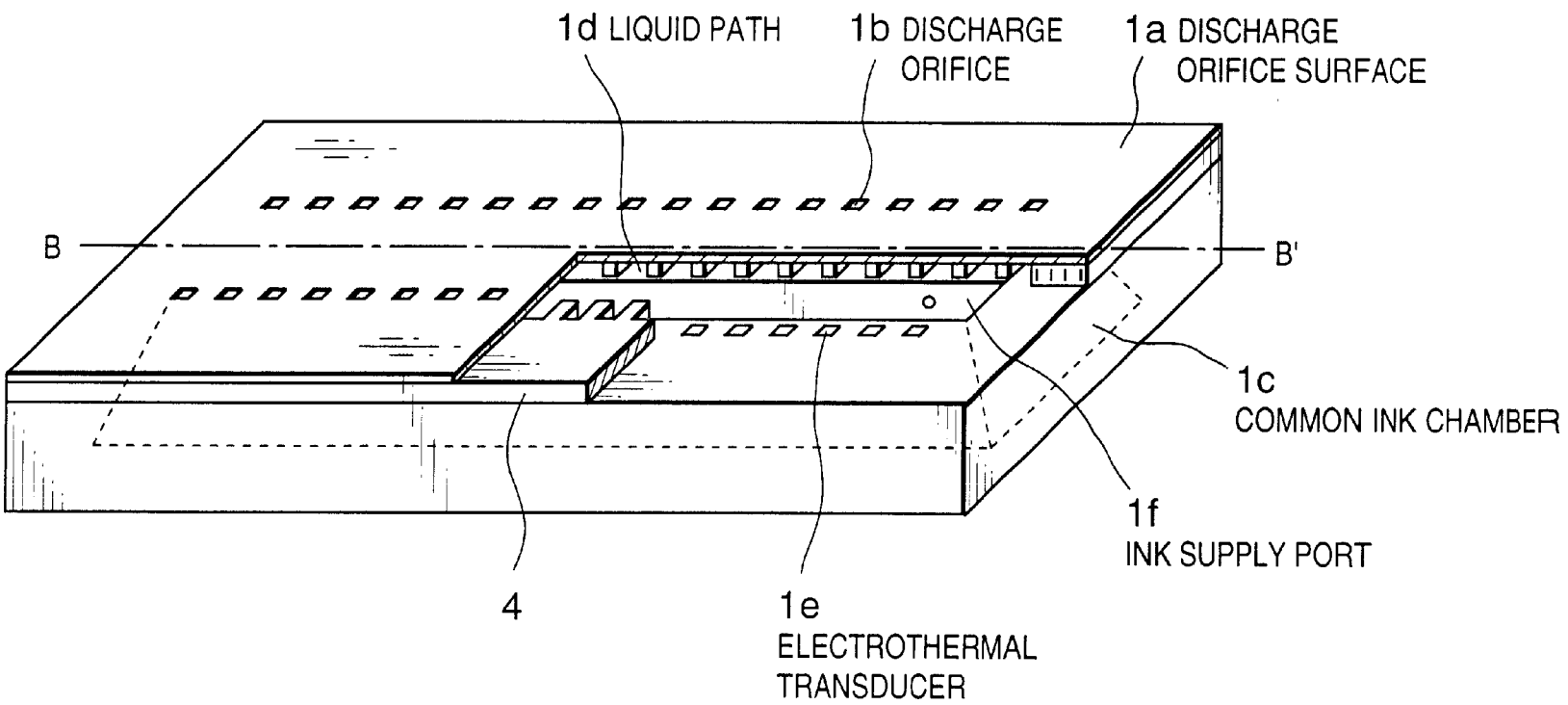
FIG. 4 is a perspective view of the main part of a printhead IJH which constructs the ink-jet cartridge IJC shown in FIG. 1.

FIG. 4 is a perspective view of the main part of the printhead IJH which constructs the ink-jet cartridge IJC shown in FIG. 1.

As shown in FIG. 4, in the printhead IJH, a plurality of discharge orifices 1*b* are formed at predetermined pitch on a discharge orifice surface 1*a* which faces against the print paper P (see FIG. 1) with predetermined spacing. In FIG. 4, reference numeral 4 denotes a substrate comprising electrothermal transducers 1*e* and an ink supply port 1*f* which is a long groove-like through hole. On each side of the elongated ink supply port 1*f*, a row of electrothermal transducers 1*e*, serving as discharge energy generators, are provided, wherein the transducers of two rows are displaced from each other slightly. A common ink chamber 1*c* is connected with each discharge orifice 1*b* through each liquid path 1*d*.

The common ink chamber 1*c* is also connected to the ink tank IT of the ink-jet cartridge IJC so as to receive ink supply from the ink tank IT. Ink supplied from the ink tank IT is temporarily stored in the common ink chamber 1*c*, then introduced to the liquid path 1*d* because of capillary phenomenon, and fills the liquid path 1*d* while forming meniscus at the discharge orifices 1*b*.

With this state, if the electrothermal transducers 1*e* are electrified through electrodes (not shown) to generate heat, ink on the electrothermal transducers 1*e* is rapidly heated and bubbles are generated in the liquid path 1*d*. As a result of bubble expansion, ink is discharged from the discharge orifices 1*b*.

Note that the first embodiment assumes that there are 256 discharge orifices 1*b* on the printhead IJH, and that the ink-jet printer IJRA is capable of printing images on paper as large as a size A3 at 1200 DPI with a driving frequency of 10 kHz.

Next, suction operation control of the ink-jet printer IJRA, having the above-described construction, is described with reference to the flowchart in FIG. 5.

In step S101, it is determined if the power of the ink-jet printer IJRA is turned on for the first time. If it is the first time, the control proceeds to step S102 where the time counter 1711*b* starts timing the non-printing state period (t2). This timing operation continues even if the power supply to the ink-jet printer IJRA is terminated. Then, the control proceeds to step S103. Meanwhile, if the power of the ink-jet printer IJRA is not turned on for the first time, step S102 is skipped and the control proceeds to step S103.

In step S103, the non-printing state period (t2) timed from the start of the printer IJRA is compared with a threshold value of a non-suction state period (hereinafter referred to as a threshold value t2th). Note that the threshold value (t2th) is determined in advance by testing how long a period the ink-jet printer can withstand non-printing state before a printhead causes discharge failure, and the determined threshold value (t2th) is set in the ROM 1702.

Herein, if $t2 \geqq t2th$, the control proceeds to step S116 which will be described later.

If $t2 < t2th$, the control proceeds to step S104 for initializing the printing period value (t1) timed by the time counter 1711*a*. Further, in step S105, the number of printed dots (X) counted by the dot counter 1712 is initialized. Next in step S106, it is determined whether or not printing operation is to be started. If NO, the control returns to step S103, but if YES, the control proceeds to step S107.

In step S107, when the printing operation begins, the time counter 1711*a* starts timing the printing period (t1). Further in step S108, the dot counter 1712 starts counting the number of printed dots (X). Note that the first embodiment assumes that the time counter 1711*a* starts timing the printing period (t1) when feeding of printing paper to the ink-jet printer IJRA is completed.

Next in step S109, it is determined whether or not printing of one sheet of print paper has been completed. When it is completed, the control proceeds to step S110 where the time counter 1711*a* terminates timing of the printing period (t1). Then in step S111, the print time duty is calculated according to equation (1).

$$X/t1 \quad (1)$$

Figure 10:
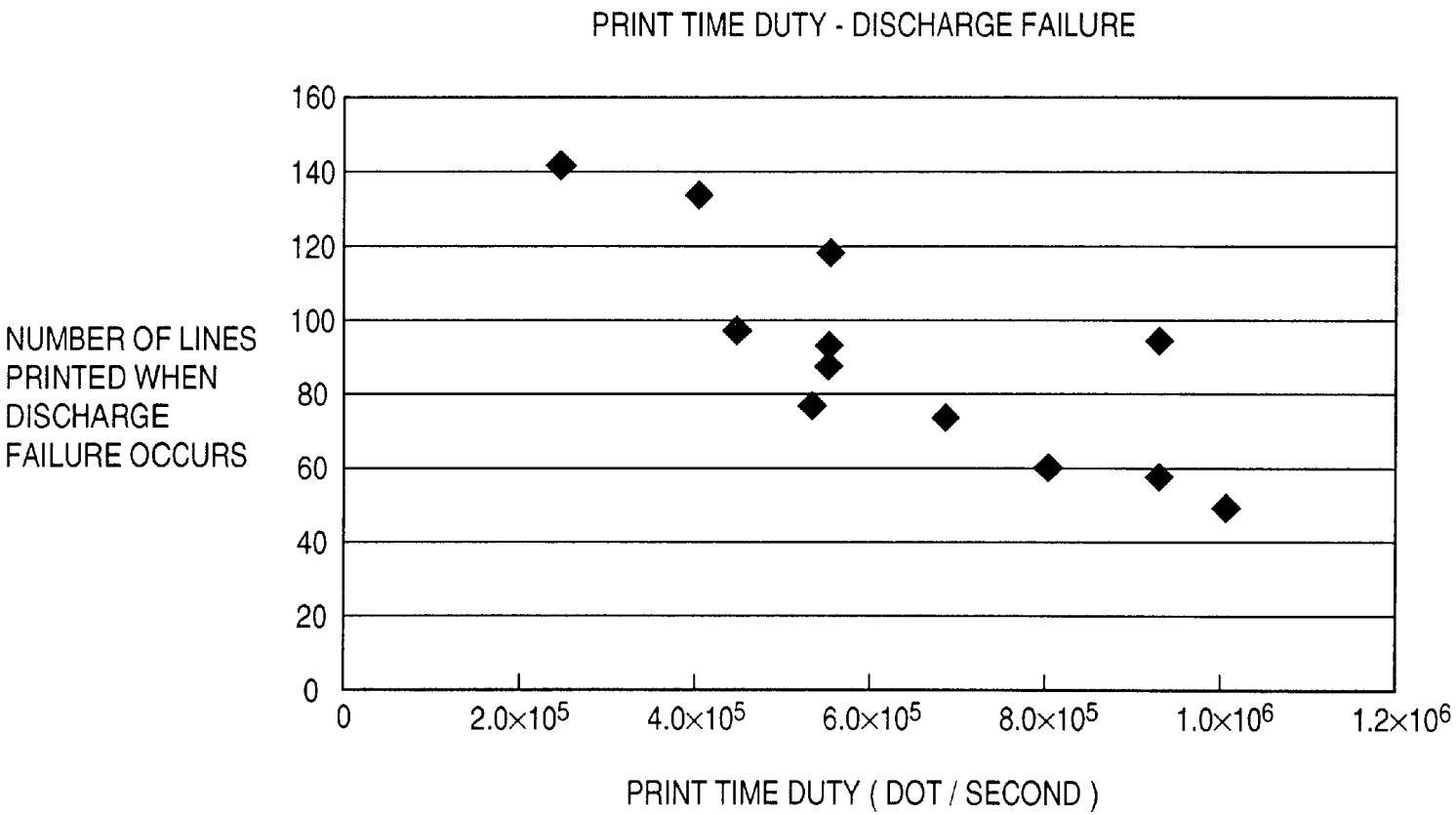
FIG. 10 shows a relation between the number of lines printed by a printhead before discharge failure occurs, and a print time duty.
Figure 11A:
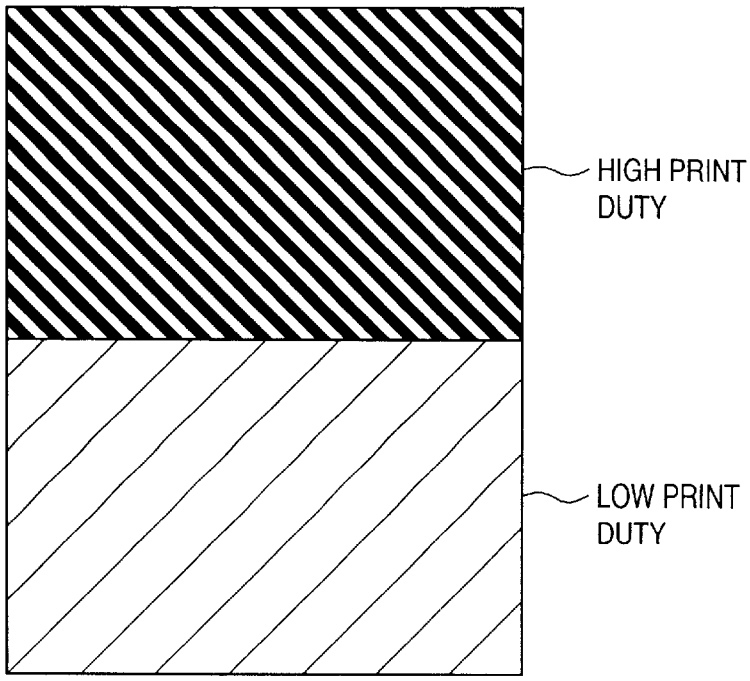
FIGS. 11A and 11B show printing patterns in which a print duty largely changes within one page of print medium.
Figure 11B:
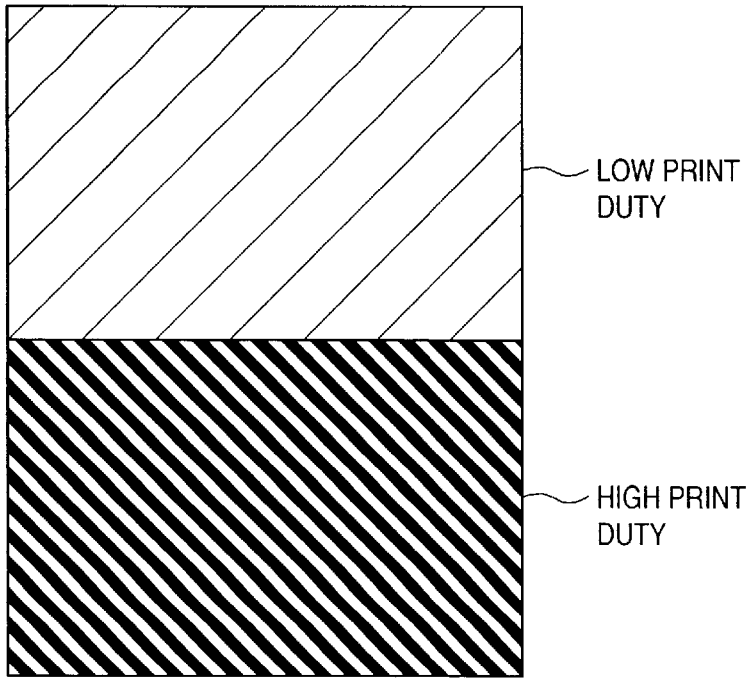

Further in step S111, based on the calculated value (X/t1) of the print time duty, a correction coefficient (α) is obtained with reference to Table 1 shown below. Correction coefficient (α) is determined in advance based on an experiment. More specifically, correction coefficients (α) for various values (X/t1) calculated by equation (1) are obtained, by changing a print image duty, or by printing a different printing pattern, e.g., a pattern having print data only in the first half of print paper. According to the first embodiment, the correction coefficient (α) and a threshold value (Yth) of a corrected print dot count value (Y) which will be described later are determined based on the relation between the number of print dots per unit time and discharge failure as shown in FIG. 10.

TABLE 1

| X/t1 | α |
|---|---|
| 0 ≦ X/t1 < 200,000 | −0.50 |
| 200,000 ≦ X/t1 < 400,000 | −0.32 |
| 400,000 ≦ X/t1 < 600,000 | 0.00 |
| 600,000 ≦ X/t1 < 800,000 | 1.00 |
| 800,000 < X/t1 | 4.00 |

Next in step S112, the corrected print dot count value (Y) is obtained according to equation (2) by using the correction coefficient (α) as a weight.

$$Y=Y+X+\alpha X \quad (2)$$

In step S113, the corrected print dot count value (Y) is compared with the threshold value (Yth). If Y≧Yth, the control proceeds to step S116. Meanwhile, if Y<Yth, the control proceeds to step S114 where the non-printing state period (t2) is compared with the threshold value (t2th). Herein, if t2≧t2th, the control proceeds to step S116. Meanwhile, if t2<t2th, the control proceeds to step S115 to determine whether or not to end printing operation. In step S115, if there is no remaining print data, the printing operation is terminated, whereas if unprinted data still remains, the control returns to step S103 for repeating the above-described process until all print data is printed.

In step S116, the recovery controller 1708 transmits a suction operation instruction to the MPU 1701 and suction device 5015. When the MPU 1701 receives the suction operation instruction in step S116, the MPU 1701 performs control such that the printing operation is halted, and that the carrier motor 1710 is driven to move the carriage HC, carrying the printhead IJH, to the position opposite from the cap 5022 for suction operation. Moreover, the MPU 1701 performs control so that the discharge orifice surface of the printhead IJH is capped by the cap 5022. Then, the recovery controller 1708 performs suction operation, in cooperation with the MPU 1701, by operating the suction device 5015.

Then in step S117, the timed non-printing state period (t2) and corrected print dot count value (Y) are initialized. Then, the control returns to step S115.

According to the above-described first embodiment, each time printing of one sheet of print paper is completed, whether or not suction operation is necessary is determined based on the number of print dots corrected according to the number of print dots per unit time and the non-printing state period. Accordingly, the number of times of suction operation for maintaining the printhead in the most appropriate condition can be kept to the minimum number of times. In addition, reduction in throughput of the ink-jet printer can be minimized, while maintaining the printhead in the most appropriate condition. Furthermore, since the number of times of suction operation is kept minimum, the amount of wasted ink can be kept small, contributing to the reduced amount of ink consumption and reduced operation cost.

Note that although the first embodiment employs the correction coefficient (α) shown in Table 1, the correction coefficient (α) varies according to the capacity of a common ink chamber of the printhead, the number of discharge nozzles, heat radiation design, or the driving frequency for controlling operation of the printhead. Therefore, the correction coefficient (α) is determined based on the specification of each ink-jet printer. In other words, values of the correction coefficient are not limited to those specified in the first embodiment.

Furthermore, although the first embodiment specifies that the time counter starts timing the printing period (t1) when feeding of printing paper to the ink-jet printer is completed, the present invention is not limited to this. The timing operation may be started at other times suitable to the construction of the printing apparatus, e.g., when the carriage HC starts moving in the main scanning direction.

Furthermore, although description is not provided in the foregoing first embodiment, an ink-jet printer may employ a control method (temperature rise detection) which allows printing only when the temperature of a printhead is lower than a predetermined temperature.

Still further, although the first embodiment has described a control method of performing suction operation based on a result of comparing respective counter values, the present invention is not limited to this. For instance, an ink-jet printer may be controlled such that suction operation is always executed after power is turned on, so as to remove ink which has become viscous or adherent during non-printing state.

Figure 5:
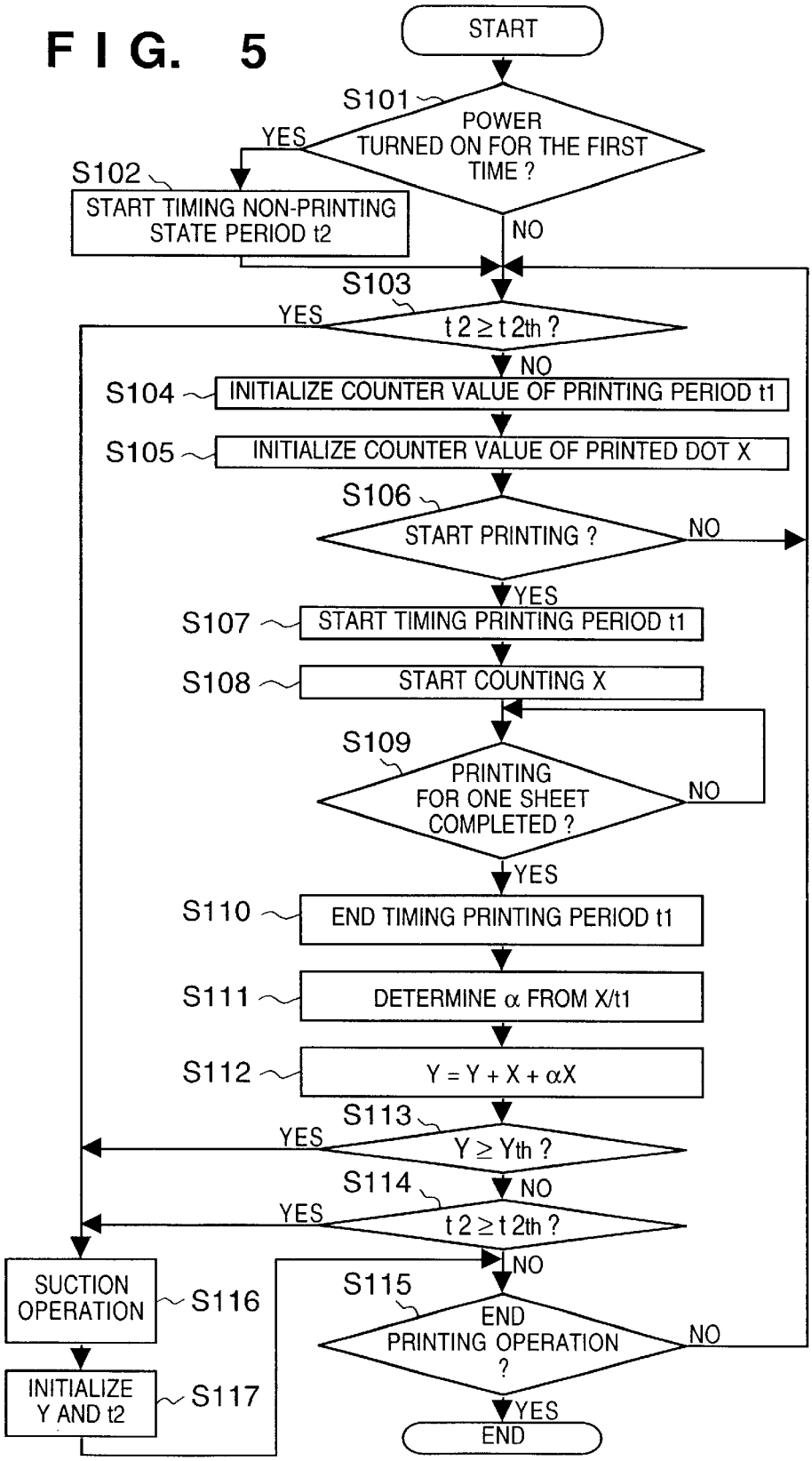
FIG. 5 is a flowchart showing control steps of suction operation according to the first embodiment.

Furthermore, in the processing explained in the flowchart in FIG. 5, although the print time duty (X/t1) is calculated each time one sheet of print paper is printed, the present invention is not limited to this. For instance, as shown in step S109*a* in FIG. 6, an ink-jet printer may be controlled such that the print time duty (X/t1) is calculated each time the printing of a single printhead scan (i.e., one line) is completed, so that the number of print dots are corrected each time printing of one line is completed. In this case, the printing period (t1) starts when a carriage carrying a printhead completes printing of one line, and ends when the carriage completes printing of the next line. In order to perform such control, step S112*a* is added to the flowchart shown in FIG. 6.

Figure 6:
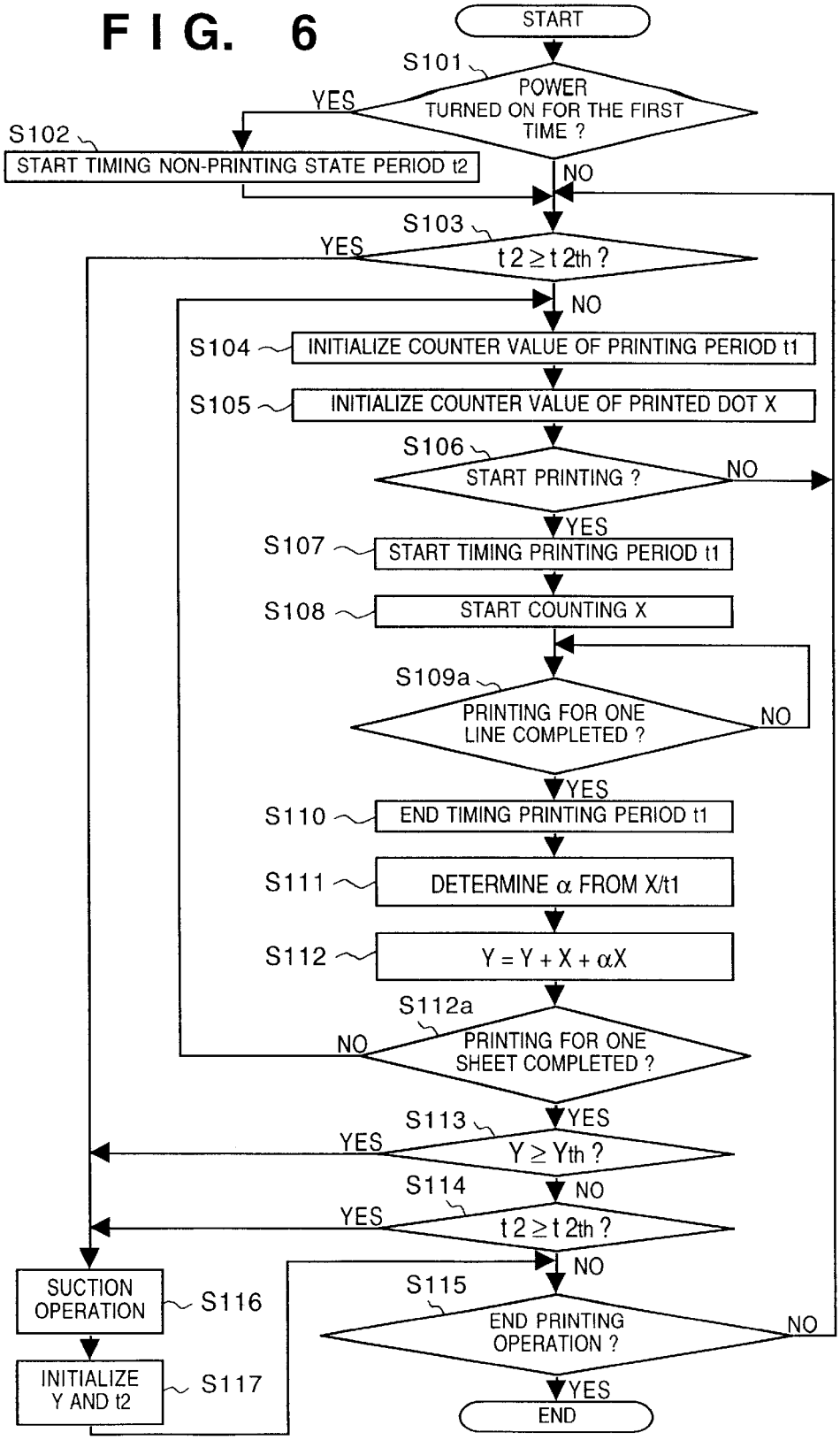
FIG. 6 is a flowchart showing control steps of suction operation according to a modified example of the first embodiment.

Note that in the flowchart in FIG. 6, processes other than steps S109*a* and S112*a* are the same as those shown in FIG. 5. Therefore, for the same processing, the same step reference numerals are assigned and detailed description thereof is omitted.

Figure 7:
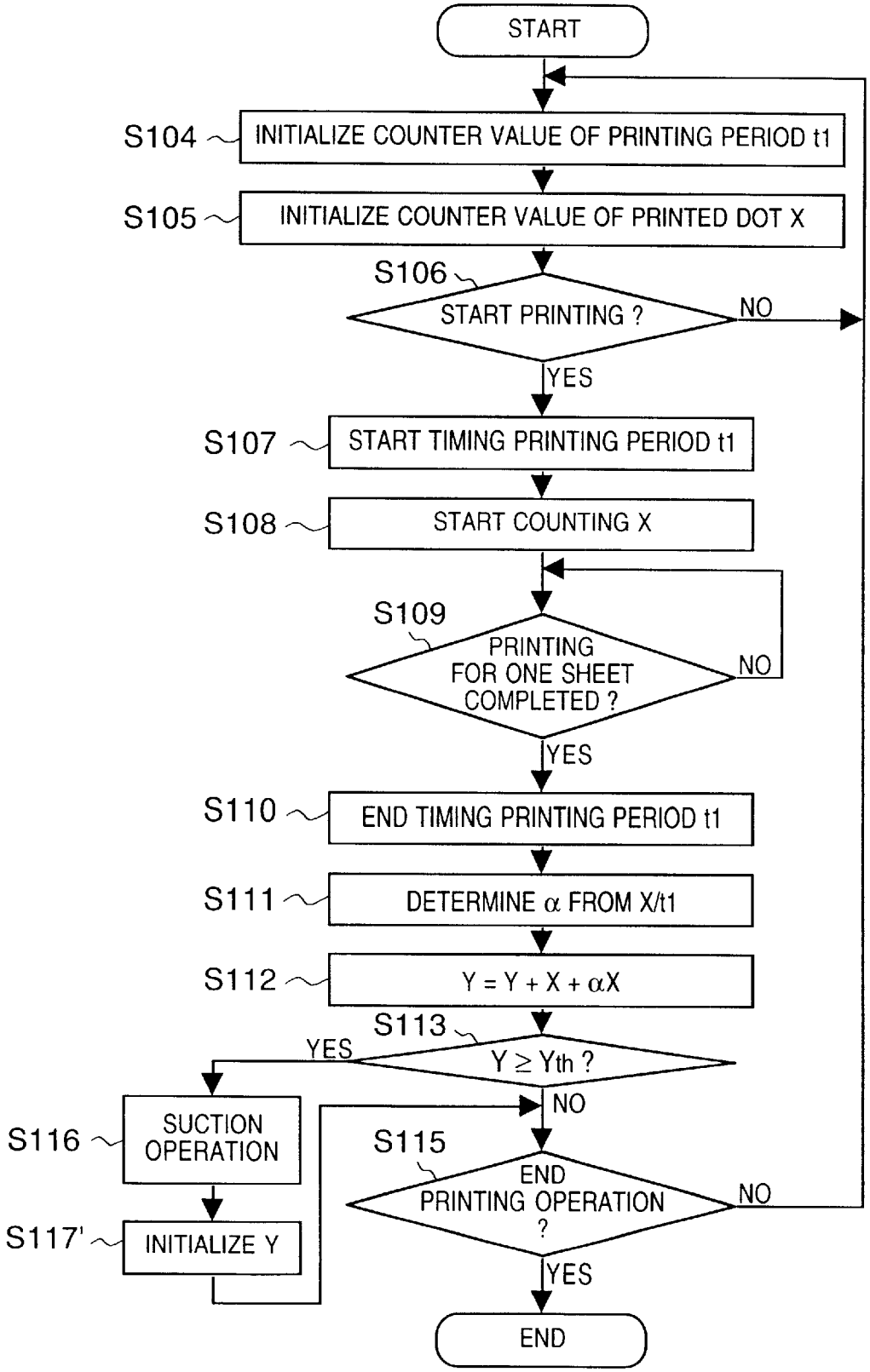
FIG. 7 is a flowchart showing control steps of suction operation according to another modified example of the first embodiment.

Moreover, if bubbles do not largely grow in a printhead in the non-printing state, the time counter 1711*b* may be eliminated from the control circuit of the ink-jet printer IJRA so as not to time the non-printing state period (t2). In this case, the processing shown in the flowchart of FIG. 5 may be substituted by the flowchart shown in FIG. 7, in which processing related to the non-printing state period (t2) is excluded. In other words, in this processing, the timing of suction operation is obtained from the print time duty.

Second Embodiment

Hereinafter, an embodiment using a control circuit which employs only one time counter is described, in comparison with the construction of the control circuit of the ink-jet printer according to the first embodiment.

Figure 8:
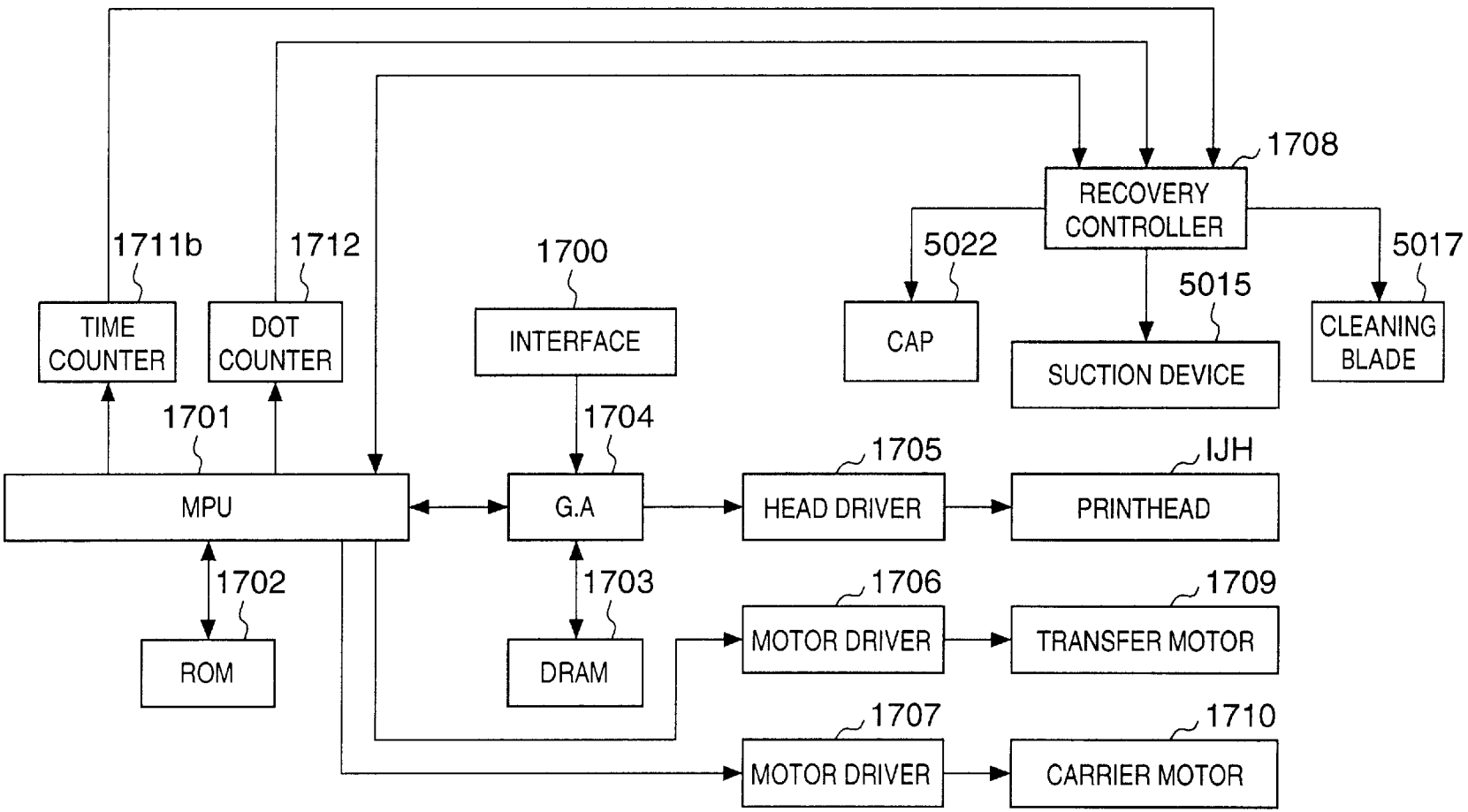
FIG. 8 is a block diagram showing a construction of a control circuit of the ink-jet printer IJRA according to the second embodiment.

FIG. 8 is a block diagram showing a construction of a control circuit of the ink-jet printer IJRA. As mentioned above, the construction shown in FIG. 8 differs from that of FIG. 2 only by the excluded time counter 1711*a*. Thus, for the same components as those shown in FIG. 2, the same reference numerals are assigned and detailed description thereof is omitted. In other words, the second embodiment does not time the printing period (t1).

Figure 9:
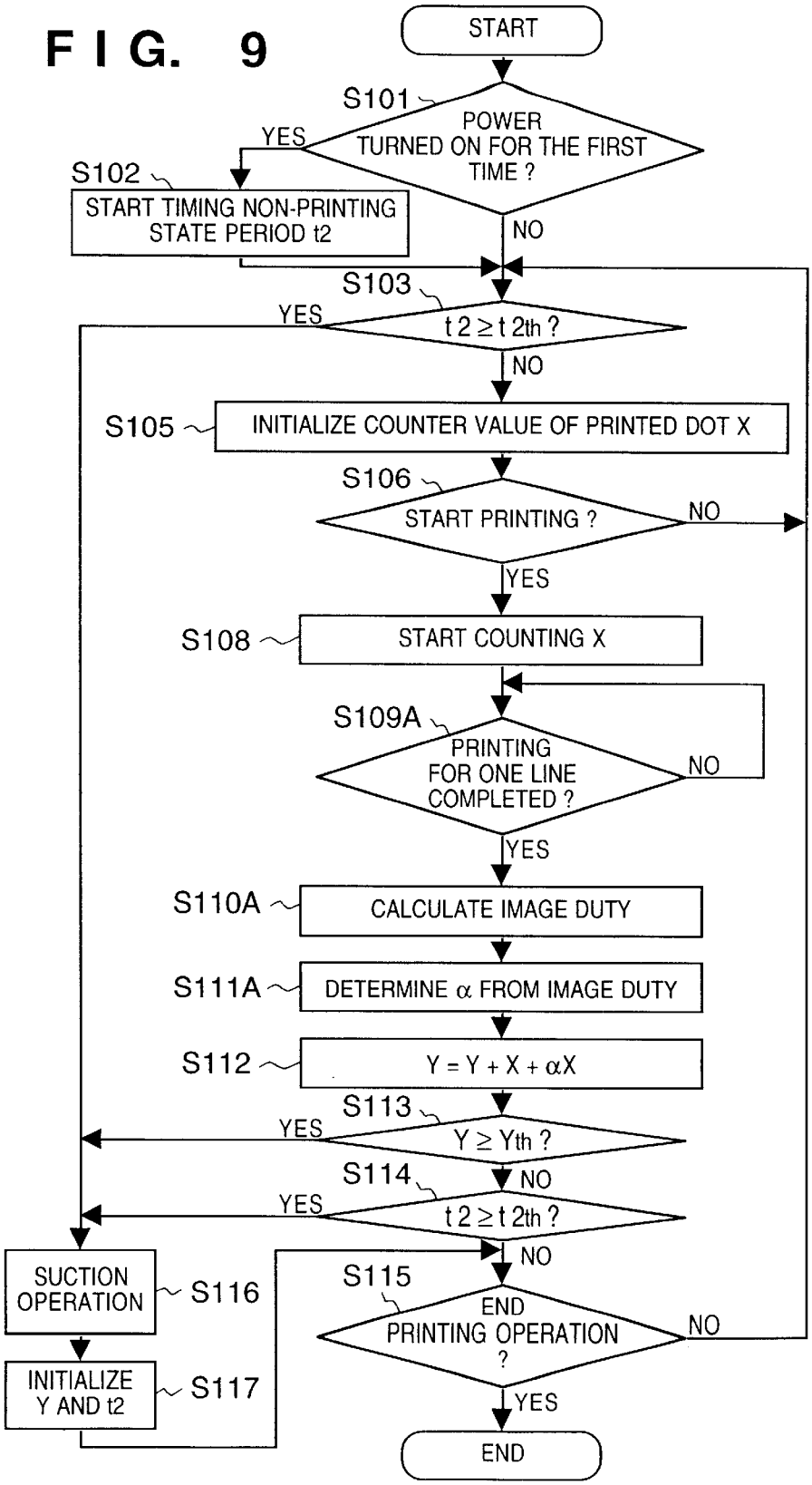
FIG. 9 is a flowchart showing control steps of suction operation according to the second embodiment.

Next, suction operation control according to the second embodiment is described with reference to the flowchart shown in FIG. 9. Note that the flowchart in FIG. 9 includes processing steps common to those in the flowchart shown in FIG. 5. Therefore, for the common processing steps, the same step reference numerals are assigned and detailed description thereof is omitted. Hereinafter, description will be provided only for the processing steps characteristic to the second embodiment.

Steps S101 to S108 are executed similarly to the first embodiment except for step S104 in FIG. 5 where the time counter 1711*a* is initialized, and step S107 in FIG. 5 where the time counter 1711*a* starts timing the printing period (t1).

Then, in step S109A, it is determined whether or not printing of a single scan of the printhead IJH (i.e., printing of one line) is completed. If YES, the control proceeds to step S110A.

In step S110A, a print image duty is calculated according to equation (3).

$$X/X\text{all} \tag{3}$$

Herein, Xall is the number of dots printed in a case where printing is performed with 100% print image duty, in other words, the total number of dots which construct the unit printing area (area printed by a single scan of printhead IJH).

Next in step S111A, a correction coefficient ($\alpha$) is obtained by referring to a table similar to the aforementioned Table 1, which shows relations between various values of print image duty and corresponding correction coefficients ($\alpha$). The correction coefficient ($\alpha$) is determined in advance, as similar to the first embodiment, by changing a print image duty, or by printing a different printing pattern, e.g., a pattern having print data only in the first half of print paper.

Then, steps S112 to S117 are executed as similar to the first embodiment.

According to the above-described second embodiment, each time printing of a single printhead scan is completed, whether or not suction operation is necessary is determined based on the number of print dots per unit printing area, i.e., the number of print dots corrected according to a print image duty, and the non-printing state period. Accordingly, the number of times of suction operation for maintaining the printhead in the most appropriate condition can be kept to the minimum number of times. In addition, reduction in throughput of the ink-jet printer can be minimized, while maintaining the printhead in the most appropriate condition. Furthermore, since the number of times of suction operation is kept minimum, the amount of wasted ink can be kept small, contributing to the reduced amount of ink consumption and reduced operation cost.

However, in a case where an operation stand-by state occurs due to image data transfer or a print stand-by state is caused by temperature rise detection or the like, it is preferable to correct the number of print dots according to the print time duty.

Note that in the foregoing embodiments, although the description has been provided based on the assumption that a droplet discharged by the printhead is ink and that the liquid contained in the ink tank is ink, the contents are not limited to ink. For instance, the ink tank may contain processed liquid or the like which is discharged to a print medium in order to improve the fixation or water repellency of the printed image or to improve the image quality.

Each of the embodiments described above comprises means (e.g., an electrothermal transducer, laser beam generator, and the like) for generating heat energy as energy utilized upon execution of ink discharge, and adopts the method which causes a change in state of ink by the heat energy, among the ink-jet printing method. According to this printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called on-demand type and continuous type. Particularly, in the case of the on-demand type, the system is effective because, by applying at least one driving signal, which corresponds to printing information and causes a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse-form driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat Nos. 4,558,333 and 4,459,600, which disclose the arrangement having a heat acting portion arranged in a flexed region is also included in the present invention. In addition, the present invention can be effectively applied to an arrangement based on Japanese Patent Application Laid-Open No. 59-123670 which discloses the arrangement using a slot common to a plurality of electrothermal transducers as a discharge portion of the electrothermal transducers, or Japanese Patent Application Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive ink from the apparatus main unit upon being mounted on the apparatus main unit, or a cartridge type printhead in which an ink tank is integrally arranged on the printhead itself, is applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independent of printing.

Furthermore, as a printing mode of the printer, not only a printing mode using only a single color such as black or the like, but also-at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ ink which is solid at room temperature or less, or ink which softens or liquefies at room temperature, or ink which liquefies upon application of a printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, ink which is solid in a non-use state and liquefies upon heating may be used. In any case, ink which liquefies upon application of heat energy according to a printing signal and is discharged in a liquid state, ink which begins to solidify when it reaches a printing medium, or the like, is applicable to the present invention. In this case, ink may be situated opposite to electrothermal transducers while being held in a liquid or solid state in recess portions of a porous sheet or through holes, as described in Japanese Patent Application Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium storing program codes for performing the aforesaid processes to a computer system or apparatus (e.g., a personal computer), reading the program codes, by a CPU or MPU of the computer system or apparatus, from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory-card, and ROM can be used for providing the program codes.

Furthermore, besides aforesaid functions according to the above embodiments are realized by executing the program codes which are read by a computer, the present invention includes a case where an OS (operating system) or the like working on the computer performs a part or the entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or the entire process in accordance with designations of the program codes and realizes- functions of the above embodiments.

The present invention is not limited to the above embodiments and various changes and modifications can be made within the spirit and scope of the present invention. Therefore, to apprise the public of the scope of the present invention, the following claims are made.

What is claimed is:

1. A suction recovery control method of controlling suction recovery operation of a printhead used in an ink-jet printing apparatus, comprising:

a first timing step of timing a printing period of predetermined printing operation;

a counting step of counting a number of print dots formed by discharging ink from the printhead during the predetermined printing operation;

a calculating step of calculating a number of print dots per unit time based on the printing period timed in said first timing step and the number of print dots counted by said counting step;

a deciding step of deciding a timing of the suction recovery operation based on the number of print dots per unit time calculated in said calculating step; and a control step of controlling the suction recovery operation of the printhead at the timing decided in said deciding step.

2. The method according to claim 1, wherein said deciding step includes:

a correction step of correcting the counted number of print dots based on the calculated number of print dots per unit time;

a first comparing step of comparing the number of print dots, corrected in said correction step, with a predetermined threshold value each time printing of one page of print medium is completed; and a determining step of determining whether or not to perform the suction recovery operation according to a comparison result of said first comparing step.

3. The method according to claim 2, further comprising a second timing step of timing a cumulative time period, starting from when power to the ink-jet printing apparatus is first turned on.

4. The method according to claim 3, wherein deciding step includes a second comparing step of comparing the cumulative time period with a predetermined threshold value each time the printing of one page of print medium is completed, wherein in said determining step, the timing of suction recovery operation is determined according to a comparison result of said second comparing step.

5. The method according to claim 1, wherein the predetermined printing operation corresponds to performing printing of one page of print medium or performing printing of one scan of the printhead.

6. The method according to claim 2, wherein the predetermined threshold value employed in said first comparing step is obtained by experimentally counting, in advance, a number of print dots formed before the printhead results in ink discharge failure.

7. The method according to claim 4, wherein the predetermined threshold value employed in said second comparing step is obtained by experimentally counting, in advance, a number of print dots formed before the printhead results in ink discharge failure.

8. The method according to claim 4, wherein in said determining step, the timing of suction recovery operation is a point of time whichever earlier: at which the number of print dots, corrected in said correction step, exceeds the predetermined threshold value in said first comparing step; or at which the cumulative time period exceeds the predetermined threshold value in said second comparing step.

9. The method according to claim 1, wherein the printhead comprises electrothermal transducers for generating heat energy to be applied to ink so as to discharge ink by utilizing the heat energy.

10. The method according to claim 9, wherein the printhead discharges ink from discharge orifices by utilizing film boiling in the ink, which is generated by heat energy applied by the electrothermal transducers.

11. A printing apparatus for printing on a print medium by using an ink-jet printhead, comprising:

suction recovery means for performing suction recovery operation of the ink-jet printhead;

first timing means for timing a printing period of predetermined printing operation;

counting means for counting a number of print dots formed by discharging ink from the ink-jet printhead during the predetermined printing operation;

calculation means for calculating a number of print dots per unit time based on the printing period timed by said first timing means and the number of print dots counted by said counting means;

decision means for deciding a timing of the suction recovery operation based on the number of print dots per unit time calculated by said calculation means; and control means for controlling the suction recovery operation at the timing decided by said decision means.

12. The apparatus according to claim 11, further comprising second timing means for timing a cumulative time period, starting from when power to the printing apparatus is first turned on, wherein said decision means decides the timing of the suction recovery operation while further considering the cumulative time period.

13. The apparatus according to claim 11, wherein said printhead comprises electrothermal transducers for generating heat energy to be applied to ink so as to discharge ink by utilizing the heat energy.

14. The apparatus according to claim 13, wherein said printhead discharges ink from discharge orifices by utilizing film boiling in the ink, which is generated by heat energy applied by the electrothermal transducers.

* * * * *

UNITED STATES PATENT AND TRADEMARK OFFICE

CERTIFICATE OF CORRECTION

PATENT NO. : 6,557,969 B1
DATED : May 6, 2003
INVENTOR(S) : Murakami et al.

It is certified that error appears in the above-identified patent and that said Letters Patent is hereby corrected as shown below:

Column 1,
Line 51, "against" should be deleted.

Column 4,
Line 65, "includes" should read -- include --.

Column 5,
Line 14, "is" should read -- be --.

Column 7,
Line 13, "an" should read -- can --.

Column 9,
Line 26, "operation" should read -- operations --; and
Line 65, "a" should read -- an --.

Column 10,
Line 8, "against" should be deleted; and
Line 39, "if" should read -- whether --.

Column 15,
Line 30, "also-at" should read -- also at --.

Column 16,
Line 22, "processes" should read -- process --; and
Line 32, "realizes-functions" should read -- realizes functions --.

UNITED STATES PATENT AND TRADEMARK OFFICE

CERTIFICATE OF CORRECTION

PATENT NO. : 6,557,969 B1
DATED : May 6, 2003
INVENTOR(S) : Murakami et al.

It is certified that error appears in the above-identified patent and that said Letters Patent is hereby corrected as shown below:

Column 17,
Line 8, "deciding" should read -- said deciding --.

Signed and Sealed this

Eleventh Day of November, 2003

JAMES E. ROGAN
*Director of the United States Patent and Trademark Office*